United States Patent [19]

Lowe, Jr.

[11] Patent Number: 4,525,878

[45] Date of Patent: Jul. 2, 1985

[54] MUSICAL HAT, CAP OR SIMILAR HEAD COVERING

[76] Inventor: Henry E. Lowe, Jr., 201 N. Edwards St., Cassopolis, Mich. 49031

[21] Appl. No.: 619,294

[22] Filed: Jun. 11, 1984

[51] Int. Cl.[3] ..... A63H 33/26

[52] U.S. Cl. ..... 2/185 R; 2/199; 84/94 C

[58] Field of Search ..... 84/94 R, 94 C, 95 C; 2/185 R, 199; 362/105, 106; 229/92.8; 40/455, 124.1

[56] References Cited

U.S. PATENT DOCUMENTS

| | | | |
|---|---|---|---|
| 1,242,211 | 10/1917 | Leihgeber | 2/199 |
| 1,572,210 | 2/1926 | Kolibas | 362/106 |
| 3,142,833 | 7/1964 | Bosley et al. | 2/185 R |
| 3,435,556 | 4/1969 | Clarke | 362/106 |
| 3,798,806 | 3/1974 | Sanford | 40/455 |
| 4,102,067 | 7/1978 | Tarrant | 40/455 |
| 4,299,041 | 11/1981 | Wilson | 40/124.1 |
| 4,406,040 | 9/1983 | Cannone | 362/106 X |
| 4,434,567 | 3/1984 | Le Veau | 84/94 C |

FOREIGN PATENT DOCUMENTS

| | | | |
|---|---|---|---|
| 1221782 | 1/1960 | France | 362/106 |

*Primary Examiner*—Louis K. Rimrodt

*Attorney, Agent, or Firm*—Marmaduke A. Hobbs

[57] ABSTRACT

A musical hat, cap or similar head covering is disclosed, having a visor portion with a compartment formed therein near the frontal portion of the visor. A musical device is disposed in the compartment and includes a switch for activating the musical device. The switch may be so located that grasping the hat by the visor in the vicinity of the switch, for tipping or waving the hat, activates the musical device which plays a short tune and then stops until reactivated.

6 Claims, 5 Drawing Figures

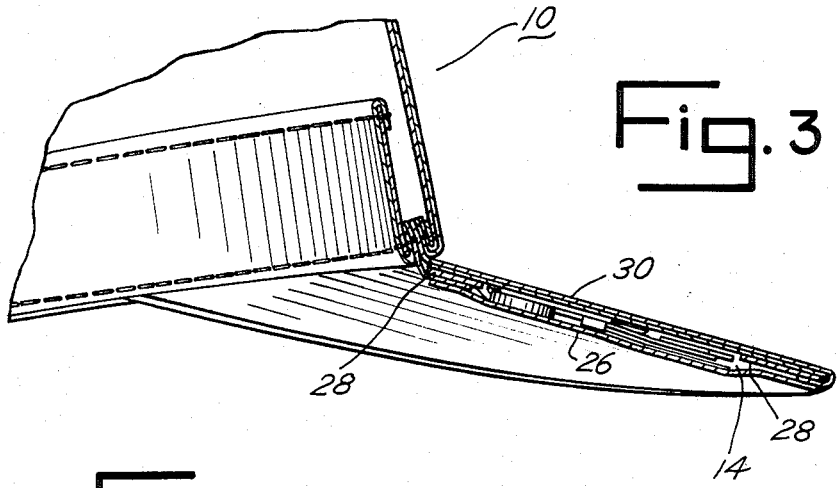
Fig. 3
Fig. 4
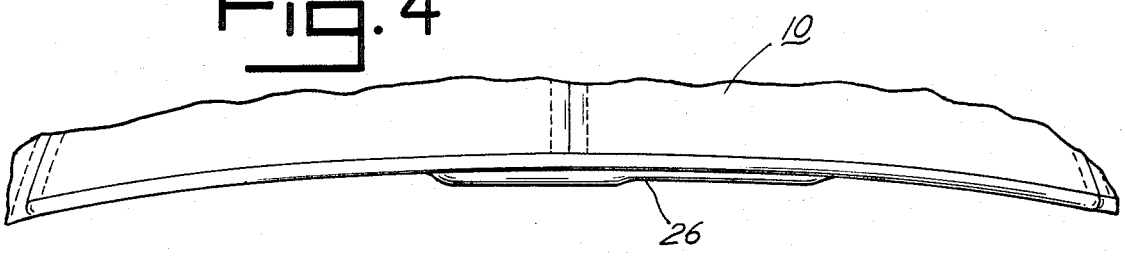
Fig. 5
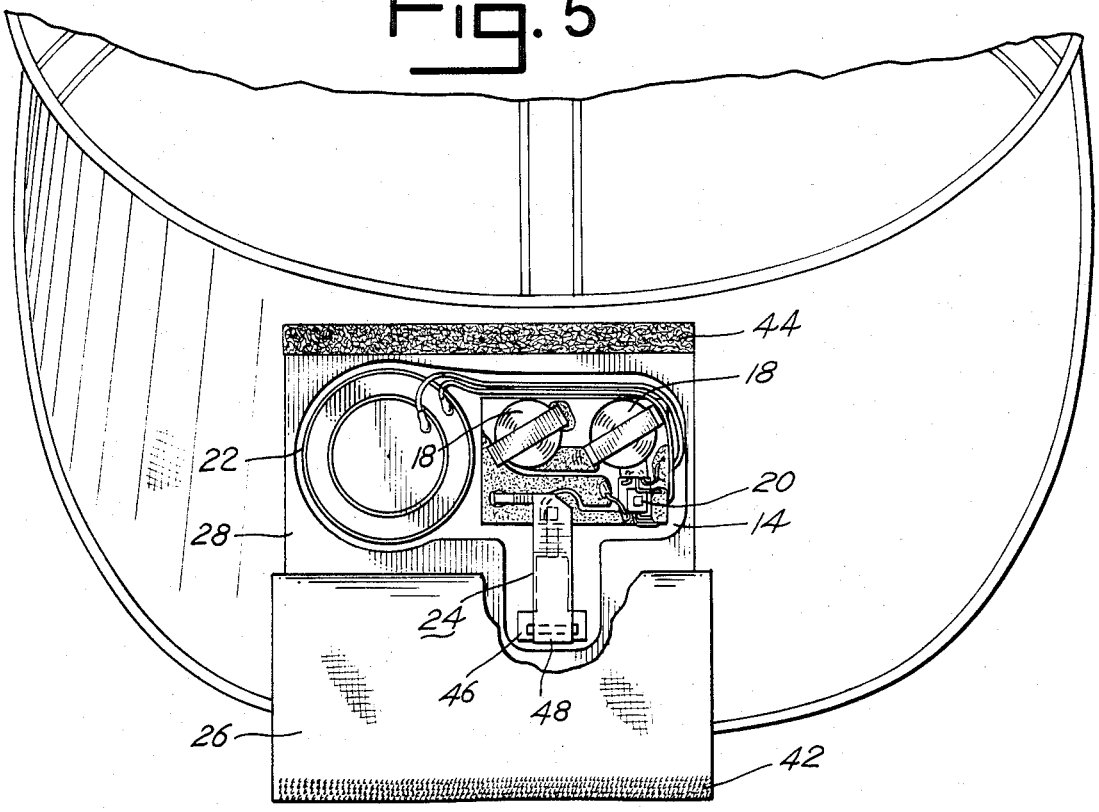

MUSICAL HAT, CAP OR SIMILAR HEAD COVERING

BACKGROUND OF THE INVENTION

In many places, tipping one's hat is a gesture of greeting, courtesy and respect. This custom is normally, but not necessarily, practiced by men in relation to women. Another form of the custom is seen at sporting events or in crowds gathered to meet politicians or other celebrities, where persons often remove and wave their hats over their heads as a form of cheering or greeting. Tipping or waving the hat is normally accomplished by grasping the bill or brim of the hat at or near its frontal portion and lifting either the rear portion or the entire hat upwardly off the head. This practice, or the lack thereof, and the extent to which the hat is tipped or lifted, is dependent on the habits of the wearer, local customs, and the particular situation, i.e. who is the recipient of the gesture. Tipping the hat is also normally accompanied by a short greeting, such as "Hello" or "Good morning", while waving the hat is normally accompanied by cheering. The custom, especially of tipping the hat, is a courteous gesture and a public display of good manners, normally presenting a good impression to the recipient of the courtesy, as well as to the casual observer.

SUMMARY OF THE INVENTION

It is, therefore, one of the principal objects of the present invention to make tipping one's hat a more widely practiced custom by equipping the hat or other head covering with a musical device that plays an appropriate tune whenever the hat or cap is grasped for tipping.

Another object of the present invention is to provide an accessible compartment in a hat or cap for inconspicuously housing the musical device in a convenient place for activation.

A further object of the present invention is to provide a hat or cap in combination with a musical device that will begin to play only when cued, and which is durable to provide a long service life.

These and other objects are attained by the present invention, which relates to a musical hat, cap or the like comprising a suitable head covering means with a musical device disposed therein. Means are provided for selectively activating the musical device when the hat or cap is grasped for tipping. The present invention may be practiced with a variety of different types of hats, and the tune played by the musical device will normally be associated with, or appropriate to, the type of hat and the occasion for which it is intended.

Various other objects and advantages of the present invention will become apparent from the description below, with reference to the accompanying drawings.

BRIEF DESCRIPTION OF THE DRAWINGS

FIG. 3 is a fragmentary cross-sectional view of the cap and bill with the musical device installed therein, the section being taken on line 3—3 of FIG. 2;

FIG. 4 is a front elevational view of the visor portion or bill of the cap with the musical device installed therein; and FIG. 5 is a fragmentary, bottom plan view of the cap, here showing the cover flap folded back to permit access to the musical device.

DETAILED DESCRIPTION OF THE PREFERRED EMBODIMENT

Figure 1:
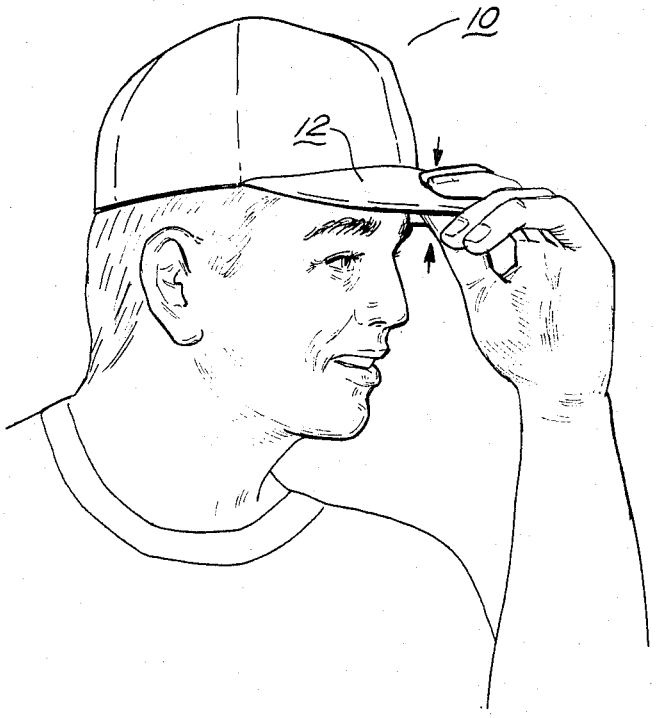
FIG. 1 is a perspective view of the musical hat embodying the present invention, shown here with the wearer in the process of tipping the cap.

Referring more specifically to the drawings, and to FIG. 1 in particular, numeral 10 designates generally a musical cap embodying the present invention. The cap shown here is a baseball-type cap; however, any suitable head covering means may be used for the present invention, such as, for example, cowboy hats, basic visors, or standard fedora-type hats. The hat will normally, but not necessarily, include a bill or brim, such as bill 12 shown here, and, for purposes of this application and the claims appended hereto, the terms "bill" and "brim" will be used interchangeably and are referred to generally as visor means. Similarly, the musical device described herein, in combination with the baseball cap 10, has been programmed to play "Take Me Out To The Ball Game" when activated, and thus would be appropriate for wearing to a baseball game, for example. Any tune may be programmed into a particular musical device and will normally be, in some way, associated with or appropriate for the type of hat or cap and the occasion for which it is intended. For example, a musical device programmed to play "Pomp and Circumstance" or the school song may be incorporated into the mortar board worn by students at graduation ceremonies.

Figure 2:
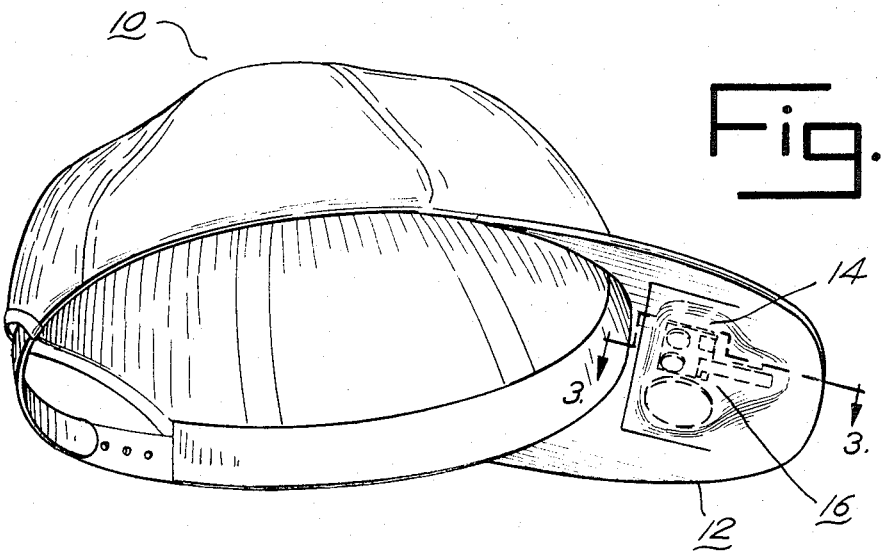
FIG. 2 is a perspective view of the bottom side of the cap, the broken lines showing the installed position of the musical device and the compartment for housing the device.

The hat or cap 10 includes a compartment 14 in bill 12 for housing a musical device 16. The musical device is inconspicuously housed within compartment 14, as shown in FIGS. 2 and 4, and includes a suitable power source, such as batteries 18 or a small solar unit, a programmed electronic chip 20, and a speaker unit 22. Extending laterally from the musical device toward the front of the hat is a suitable switch means 24 for selectively activating the musical device. The device may be fastened within the compartment in any suitable manner, a preferred method being the use of a releasable adhesive which permits removal of one device and the substitution of another to change tunes, for example.

As seen in FIGS. 3 and 5, compartment 14 is formed by separating a flap or layer of cloth 26, which forms part of the bottom surface of bill 12, from the adjacent layer or layers which form the remainder of the bill. In this case, the bill has a stiffening means, such as a layer of cardboard 28, disposed therein, and a top layer of cloth 30. The cardboard layer in the embodiment shown has been trimmed to accommodate the musical device, however, the device has minimal thickness and may also be surface mounted onto the stiffening layer. Flap 26 includes a suitable fastening means around the border thereof, such as the hook and loop material sold under the trademark "Velcro". The flap contains the hook portion 42 and the bill contains the loop portion 44, these positions being interchangeable. The flap is designed to provide access to the musical device for changing batteries, for example, or for removing a particular device and inserting another. The compartment may be formed in any hat or cap, either by separating the multiple layers which form the visor means, or by adding a covering means or flap of suitable size to a single layer visor. The compartment also has minimal thickness, as shown in FIGS. 3 and 4, making it unobtrusive and ensuring that it does not obstruct the line of vision of the wearer.

Switch means 24 has normally separated contact arms 46 and 48 for activating the musical device. The arms are disposed near the outer periphery of bill 12, this being the area of the bill which is normally grasped for tipping the hat. The contact arms are sensitive to a slight pressure, such that a light touch applied to the bill in the general vicinity of the contact arms will deflect flap 26 sufficiently to bring the contact arms into engagement, thereby activating the musical device, as shown in FIG. 1. It is not necessary to maintain the contact between arms 46 and 48, as the device begins to play its tune upon activation and continues to play as programmed. For example, the musical device shown herein plays two choruses of "Take Me Out To The Ball Game" upon activation, aand then ceases to play until activated again.

In the use and operation of the present musical cap 10, the visor means or bill 12 of the cap is prepared to receive the musical device. One or more of the layers which form the bill are separated from the adjacent layer or layers to form a compartment 14 in the bill, or the musical device may be surface mounted onto a single layer visor with a suitable cover means added. The musical device may be secured within the compartment in any convenient manner, such as by the use of a releasable adhesive, which permits substitution of one device for another. The separation of layers, or the addition of a cover layer, provides a covering means or flap 26 to protect and conceal the device within the bill. The flap has a releasable fastening means such as a hook and loop fastener with, for example, the hook portion 42 disposed on the flap and the loop portion 44 disposed on the bill. This provides access for changing batteries, for example, or for changing to a device that plays a different tune. The device is mounted in the compartment with the switch contact arms 46 and 48 oriented toward the front of the hat or cap, and the flap 26 is fastened in place over the musical device.

Slight contact pressure applied to the flap anywhere in the general vicinity of the switch meaans 24, such as that applied when the bill of the cap is grasped for tipping or waving the hat, is sufficient to activate the musical device. Once activated, contact between the switch arms 46 and 48 need not be maintained, since the device will play as programmed and then stop. For example, the device may be programmed to play a single chorus of "Home On The Range" and then stop, until contact pressure is again applied in the switch area to reactivate the device.

In the claims, the word "hat" is used generically and means and includes all head coverings mentioned herein, including caps, unless otherwise indicated or defined.

While one embodiment of a musical hat and modifications thereof have been shown and described in detail herein, various other changes and modifications may be made without departing from the scope of the present invention.

I claim:

1. A musical hat comprising:

a. head covering means adapted for wearing on the head of a person and having a visor means projecting outwardly therefrom, said visor means having upper and lower layers and a compartment between said layers;

b. an electrical musical device disposed in said compartment; and c. a switch means in said compartment connected to said device and engageable by one of said layers when said visor is grasped by the wearer for activating said device.

2. A musical hat as defined in claim 1 in which said visor means projects radially from said head covering means, and said compartment is disposed near the center of said visor means.

3. A musical hat as defined in claim 1 in which said visor means projects outwardly from the front of said head covering means, and said compartment has a releasable closure means formed in said visor means for access to said musical device.

4. A musical hat as defined in claim 3 in which said switch means includes normally separated contact arms disposed in said compartment near the periphery of said visor means, said arms being deflectable for contacting one another and activating said device.

5. A musical hat as defined in claim 1 in which said compartment includes a cover flap having a releasable fastening means thereon for covering and providing access to said compartment.

6. A musical hat as defined in claim 1 in which said switch means includes two normally separate contact arms disposed near the periphery of said visor means, and being deflectable for contacting one another.

* * * * *